US006554783B2

(12) United States Patent
McEvoy

(10) Patent No.: US 6,554,783 B2
(45) Date of Patent: Apr. 29, 2003

(54) COMPRESSION GLOVE AND METHOD OF FITTING THE SAME

(76) Inventor: Bunty McEvoy, P.O. Box 13, Rose Bay, N.S.W. (AU), 2029

( * ) Notice: Subject to any disclaimer, the term of this patent is extended or adjusted under 35 U.S.C. 154(b) by 49 days.

(21) Appl. No.: 09/944,904

(22) Filed: Aug. 30, 2001

(65) Prior Publication Data

US 2002/0029401 A1 Mar. 14, 2002

Related U.S. Application Data

(62) Division of application No. 09/413,070, filed on Oct. 6, 1999, now abandoned.

(51) Int. Cl.[7] ..... A61F 13/00; A61F 5/00; A41D 19/00

(52) U.S. Cl. ..... 602/21; 602/61; 2/161.7

(58) Field of Search ..... 602/20, 21, 22, 602/75, 60–62, 64; 2/159–161.9

(56) References Cited

U.S. PATENT DOCUMENTS

| | | | | | |
|---|---|---|---|---|---|
| 5,782,790 | A | * | 7/1998 | Allen | 602/75 |
| 6,086,551 | A | * | 7/2000 | Allen | 602/19 |
| 6,135,974 | A | * | 10/2000 | Matz | 602/62 |
| 2002/0035793 | A1 | * | 3/2002 | Byrd | 36/8.4 |

* cited by examiner

*Primary Examiner*—Kim M. Lewis
(74) *Attorney, Agent, or Firm*—Fulbright & Jaworski LLP

(57) ABSTRACT

A compression glove formed from a composite fabric of approximately 80% nylon and 20% spandex which is stretchable in all directions to continuously apply pressure to the hand of a wearer for long periods of time to treat or relieve symptoms of various medical conditions.

3 Claims, 5 Drawing Sheets

| | | | | |
|---|---|---|---|---|
| | | SMALL | | |
| V8083L SK | LADIES | GLOVE TO WRIST | NEW SKIN | 24.00 |
| V8083L NV | LADIES | GLOVE TO WRIST | NAVY | 24.00 |
| V8083LL SK | LADIES LONG | EXTENDED BEYOND WRIST BY 8 cms | NEW SKIN | 24.00 |
| V8083LL NV | LADIES LONG | EXTENDED BEYOND WRIST BY 8 cms | NAVY | 24.00 |
| | | MEDIUM | | |
| V8083 SK | REGULAR (STANDARD) | GLOVE TO WRIST | NEW SKIN | 24.00 |
| V8083 NV | REGULAR (STANDARD) | GLOVE TO WRIST | NAVY | 24.00 |
| V8083 BL | REGULAR (STANDARD) | GLOVE TO WRIST | BLACK | 24.00 |
| V8084 SK | REGULAR LONG | EXTENDED BEYOND WRIST BY 8 cms | NEW SKIN | 25.00 |
| V8084 NV | REGULAR LONG | EXTENDED BEYOND WRIST BY 8 cms | NAVY | 25.00 |
| V8084 BL | REGULAR LONG | EXTENDED BEYOND WRIST BY 8 cms | BLACK | 25.00 |
| | | LARGE | | |
| V8085SHSK | EXTRA LARGE | EXTENDED BEYOND WRIST BY 7 cms | NEW SKIN | 24.00 |
| V8085SHNV | EXTRA LARGE | EXTENDED BEYOND WRIST BY 7 cms | NAVY | 24.00 |
| V8085 SK | EXTRA LARGE & EXTRA LONG | EXTENDED BEYOND WRIST BY 12 cms | BLACK | 24.00 |
| V8085 NV | EXTRA LARGE & EXTRA LONG | EXTENDED BEYOND WRIST BY 12 cms | NEW SKIN | 25.00 |
| | | CHILDREN'S | | |
| V8087SK | 4–7 YEARS | GLOVE TO WRIST | NEW SKIN | 27.00 |
| V8087NV | 4–7 YEARS | GLOVE TO WRIST | NAVY | 27.00 |
| V8088SK | 8–12 YEARS | GLOVE TO WRIST | NEW SKIN | 27.00 |
| V8088NV | 8–12 YEARS | GLOVE TO WRIST | NAVY | 27.00 |

FIG. 7

COMPRESSION GLOVE AND METHOD OF FITTING THE SAME

CROSS-REFERENCE WITH RELATED APPLICATIONS

This application is a Divisional of application Ser. No. 09/413,070, filed Oct. 6, 1999, now abandoned, which is incorporated herein by reference.

FIELD OF THE INVENTION

The present invention relates generally to gloves and more particularly to compression gloves useful for medical treatment.

BACKGROUND OF THE INVENTION

It is well known that many individuals suffer from rheumatoid arthritis, oedema primary lymphoedema, and other health problems which generate discomfort including pain and stiffness, particularly upon first arising after sleep. It is common for such individuals to take various types of drugs and pain relieving over-the-counter medications to obtain relief from many of the conditions.

It has long been realized that the application of pressure to affected areas involving these discomfort causing medical problems of the type above discussed can provide at least some relief. Various pressure garments have been devised and for the most part are relatively successful in their applications. However, applicant is unaware of any pressure garments useful for successfully applying pressure to the manus or hands in a manner which is acceptable for treatment of the various conditions above referred to.

Various types of gloves are well known and some in fact can be used to apply pressure. For example, latex gloves which are made from a variety of elastomers are light and flexible, tightly fitting and can be used in various medical applications. However, such gloves vary from glove to glove insofar as the fit is concerned and the pressures applied by such gloves when worn for a substantial period of time, such as overnight, unduly restricts the blood vessels in the manus of the wearer causing numbness and general discomfort for the wearer.

There is a need for compression gloves which may be worn for long periods of time by the user and which will apply a predetermined pressure to the metacarpus, phalanges and, if desired, the carpus of the wearer to relieve pain and to provide other beneficial treatments for various conditions that will not result in the application of undue amounts of pressure causing numbness, fatigue and discomfort to the wearer.

SUMMARY OF THE INVENTION

A compression glove in accordance with the present invention includes a layer of elastomeric fabric which encases the manus of the wearer and which is formed to be substantially smaller than the manus of the wearer when the glove is in its fully relaxed state and which is stretchable in all directions to closely fit the manus of the wearer and apply continuous compression to the manus of the wearer when the glove is in place on the manus of the wearer.

The method of fitting the compression glove constructed in accordance with the present invention is to provide a plurality of templates comprising an outline of a person's hand. Each such template being of a different size, placing the wearer's hand against the template and determining the template most nearly the size of the wearer's hand, providing a chart setting forth various gloves sizes, comparing the determined template to the chart and selecting the glove size designated on the chart most applicable for that wearer.

BRIEF DESCRIPTION OF THE DRAWINGS

FIG. 7 is a chart setting forth various glove sizes.

DETAILED DESCRIPTION

Figure 1:
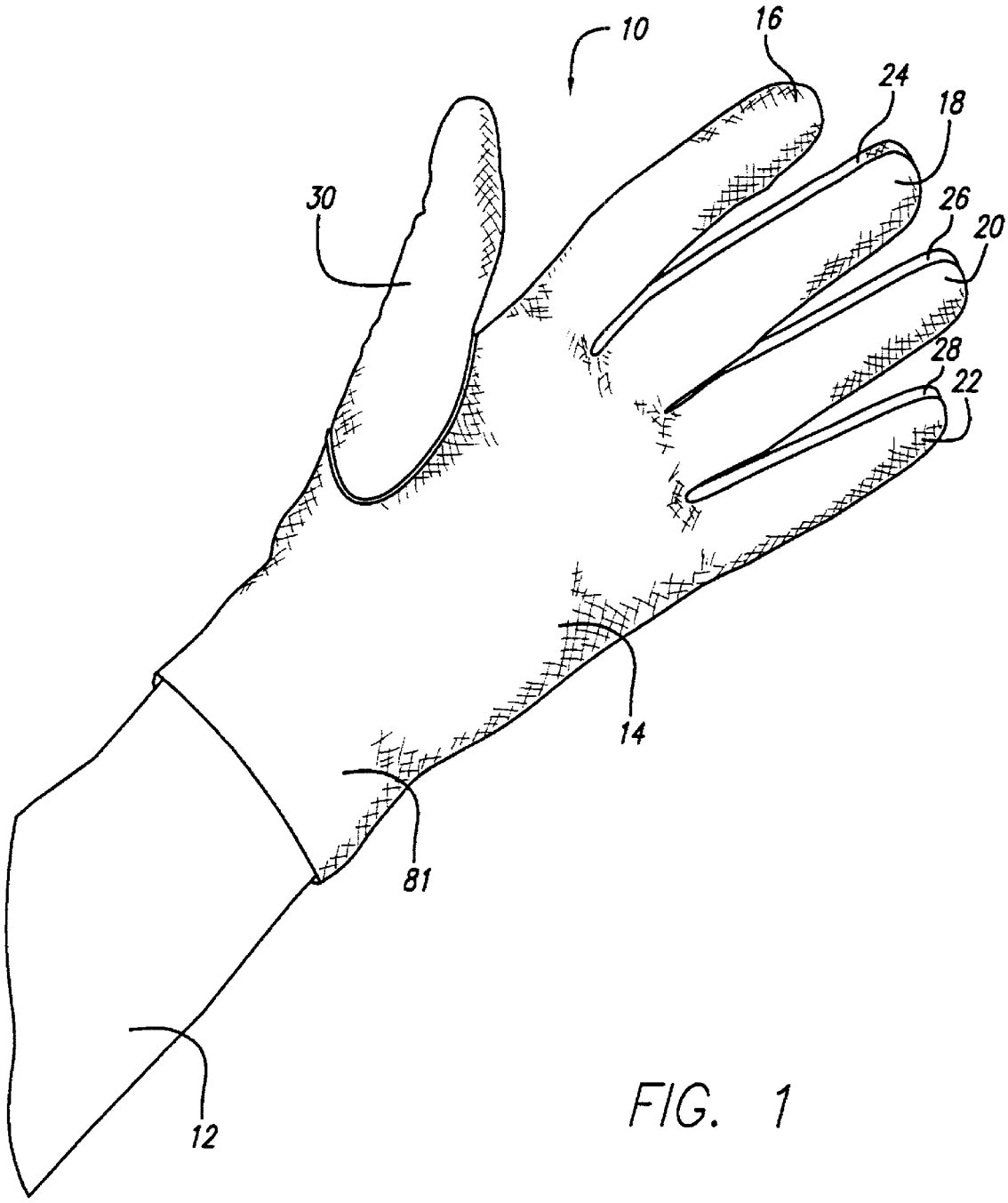
FIG. 1 is a perspective view of a compression glove constructed in accordance with the present invention on the hand of a wearer.

The compression glove of the present invention is useful for the management of many medical problems such as oedema, rheumatoid arthritis, primary lymphoedema of the hand, scars (in combination with silicone/polymer gel) and when venous return is desired. The compression glove of the present invention may also be used as an interim care garment for burns, to retain dressing upon wounds, to enhance the effectiveness of various types of creams or other medications for treatment of skin conditions and as sun protection on newly healed skin.

Such compression gloves to be effective must be constructed of a fabric which allows an excellent range of motion and thus must be soft and flexible. In order for the wearer to utilize the compression gloves over an extended period of time they must be very comfortable as well as durable. Since the end goals of the compression gloves is to apply a firm and continuous pressure to the desired area, namely, the manus the fabric from which the gloves are manufactured must be such that the desired pressure can be obtained and that it can be maintained over a substantial period of time without degradation. It is also important that the gloves be designed to be fitted in such a manner that they may be worn at night while the patient is sleeping without the gloves coming off.

In order to accomplish the goals of the compression glove of the present invention, it has been found that the fabric must be such as to be stretchable in all directions so that it may be configured in its fully relaxed state such that it is slightly smaller than the manus of the wearer, but which will easily stretch in all directions simultaneously to receive the manus of the wearer and then have elasticity sufficient that it will be able to continuously apply pressure to the metacarpus and phalanges of the wearer once the glove is in place. The fabric is preferably woven from synthetic fibers which are capable of meeting the above referred to conditions. The preferred fibers are a composite of polyamide fibers and polyurethanes fibers, also classified generally as spandex fibers. The polyamide fibers such as nylon 6, 6 or nylon 6 melt spun into a continuous filament yarn, is highly oriented and has a tenacity of 6 to 9 grams per denier, has a high extensibility and an unusually low modulous at low strength. Its resilience characteristics are good and it has great strength and ability to absorb energy. Nylon 6, 6 is capable of being blended with other fibers on the woolen, worsted and cotton systems of spinning. By blending the nylon 6, 6 with other fibers such as the spandex fibers, it imparts an amazing resistence to wear and reduces felting shrinkage greatly. The most preferable of the spandex fibers for use in the present invention is a segmented polyurethane manufactured by Dupont and sold under the trademark Lycra. Lycra has an ultimate extension of about 600% and a reasonably good tenacity of 0.6 to 0.8 grams per denier. Lycra is superior to other elastomers such as rubber and has resistence to sunlight, abrasion, oxidation, oils and chemicals. It has a good flex life and is elastically reversible. When nylon 6, 6 and spandex, such as Lycra, are combined in a ratio of 80% to 20%, in accordance with the preferred embodiment of the present invention, an excellent elastomeric fabric is provided which accomplishes all of the requirements and goals of the compression glove constructed in accordance with the principles of the present invention.

As is illustrated in FIG. 1, the compression glove 10 is in place upon the manus and extends slightly along the carpus 12 of the wearer. The glove 10 includes a metacarpus encasing member 14 which wraps around the metacarpus of the wearer and as will be described below when properly stitched together provides coverage of the phalanges as shown at 16, 18, 20 and 22. An appropriate insert 24, 26 and 28 is utilized to complete the phalange coverings 16 through 22, respectively. An element 30 is stitched into an opening provided in the member 14 as again will be more fully discussed herein below.

Before the wearer inserts his or her hand into a glove 10, the glove is substantially smaller than the size of the wearer's hand and thus must extend or stretch in all directions in such a manner that the hand of the wearer may be inserted. The elasticity of the elastomeric material from which the glove 10 is made must be sufficient throughout its entirety that it will provide a continuous and firm pressure against the wearer's metacarpus and phalanges on a continuous basis for a substantial period of time, but at the same time will not provide such a pressure as to cut off blood flow, create fatigue or discomfort to the wearer. In order to accomplish this, it becomes critical that the glove 10 be fitted to the hand of the wearer in an appropriate fashion as will be described more fully below.

Figure 2:
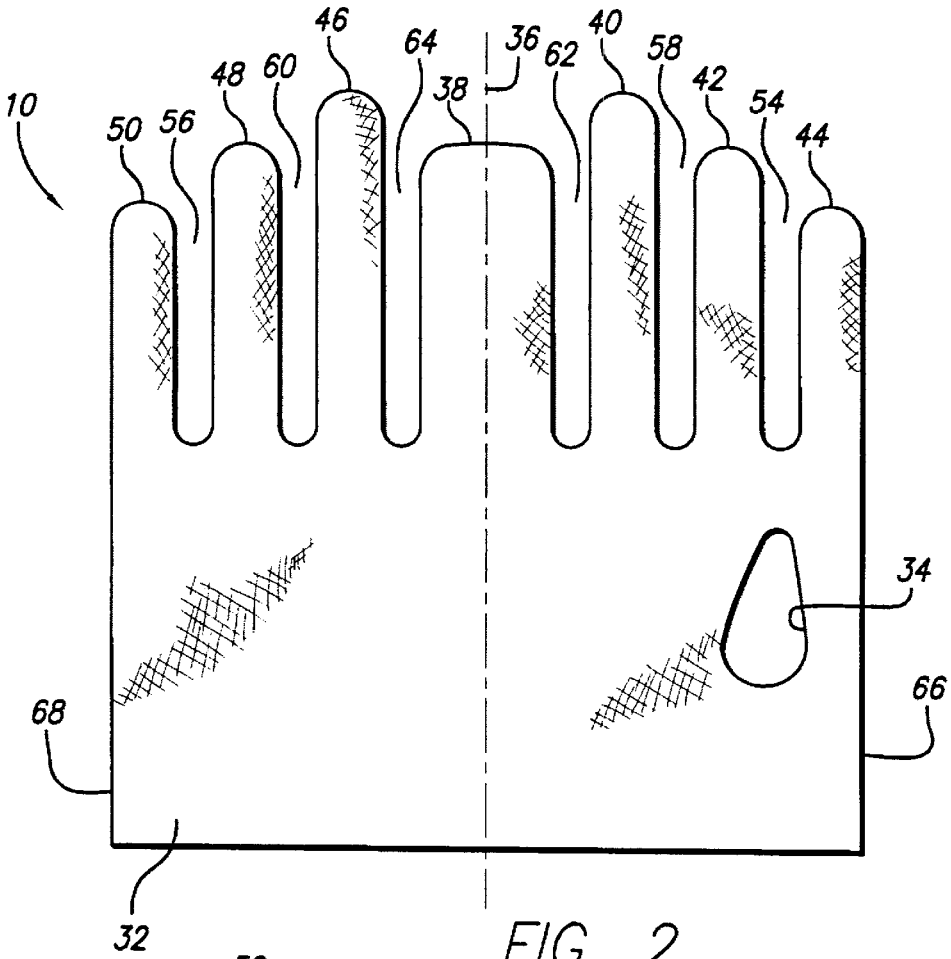
FIG. 2 is a plan view of a cut out from a sheet of fabric utilized to form the glove of the present invention.
Figure 3:
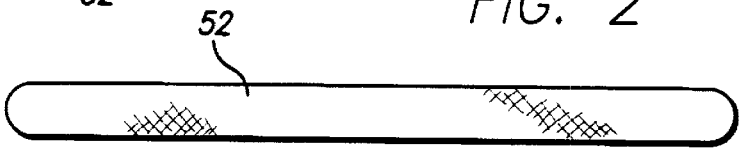
FIG. 3 is a plan view of an insert which is used to complete the fingers of the glove.
Figure 4:
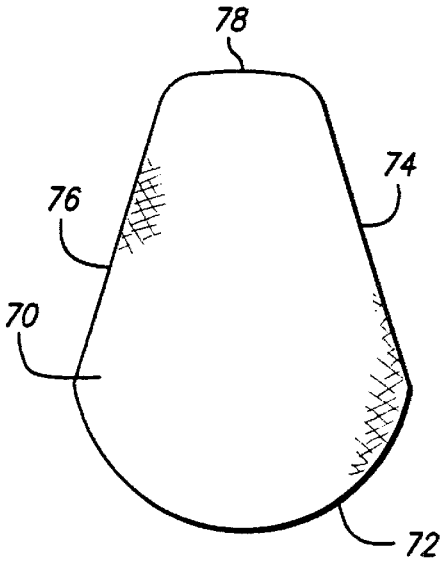
FIG. 4 is a cut out used for the thumb of the glove.

Turning now to the manner in which the glove 1 is manufactured, reference is made to FIGS. 2, 3 and 4. As is illustrated in FIG. 2, a cut out 32 is made from a continuous sheet of the nylon/Lycra composite woven material. The cut out 32 also has an opening 34 provided therein for construction of the thumb element 30 as shown in FIG. 1. The cut out 32 may be viewed as a plan form which is symmetrical about the center line 36 which is taken through a central segment 38. The segments 40, 42 and 44 to the right of the center line 36 are mirror images of the segments 46, 48 and 50 to the left of the center line 36 as viewed in FIG. 2. The cutout 32 will be folded about the center line 36 so that the segment 38 will form the enclosure for the little finger. The segments 42 and 48 for the third finger, 40 and 46 for the middle finger, while the center segment 38 is folded over to provide the enclosure for the index finger. It will be recognized by those skilled in the art that when the cutout 32 is folded over, the various segments 38 through 50 will lie flat one upon the other in a matching manner as to width and length. If these segments were merely stitched together along the edges, the resulting enclosure would have substantial stress along those edges and would provide areas of discomfort and undue pressure being applied to the wearer's phalanges. As a result it has been found that it is more effective and provides a more consistent application of pressure by the glove to bring the segments that oppose each other adjacent and to stitch an insert such as that shown at 52 in FIG. 3 in the spaces 54 and 56 to interconnect the segments 44 and 50 and 42 and 48 together. A similar insert such as that shown at 52 is also placed within the spaces 58 and 60 and stitched to connect the segments 40, 46 together along with the opposite facing edge of the opposed segments 42 and 48. A similar insert 52 is also placed within the openings 62 and 64 and stitched to the segments 40, 46 and the periphery of central segment 38. The outer edges 66 and 68 of the cutout 32 are then stitched together to thus provide a manus encircling or encasing portion of the glove. An additional cut out 70 as shown in FIG. 4 is configured in such a manner that its lower edge 72 can be formed in a circle to fit the opening 34 and stitched therealong and to be stitched in addition along the edges 74 and 76 and across the top 78 to form an enclosure for the thumb. When thus fully completed there is provided a compression glove as shown at FIG. 1.

As above pointed out, it is important that the glove 10 be properly fitted to the user to provide the optimum application of pressure and to obtain the desired results. It has been found that if a user determines the appropriate size of his hand compared to a standard insofar as is possible, then that size can be compared to an appropriate fitting chart and the user may then order the appropriate size glove for that user's particular hand. By way of example, reference is now made to FIG. 5 which is a measuring chart for a medium-sized hand. The user would place his hand, in this instance left hand, palm down in a relaxed condition and then view the hand as it appears with regard to the template 80 shown in FIG. 5 and determine whether or not his or her hand is larger, smaller or equal to the size of the template 80 drawn on FIG. 5. It is important that the web areas between the fingers be placed at the corresponding position on the template. If the hand for example, of the user completely covers the template in FIG. 5, then obviously it does not comply. Under such circumstances, the user would then go to a different and larger template such for example, as that shown at 82 in FIG. 6. The user under the circumstances specified would then place his or her hand on the template 82 and determine whether or not this more closely resembled the user's hand than did the template 80 shown in FIG. 5. If such is the case, then the user would recognize that his or her hand fits within the category on the measuring chart designated large.

Figure 5:
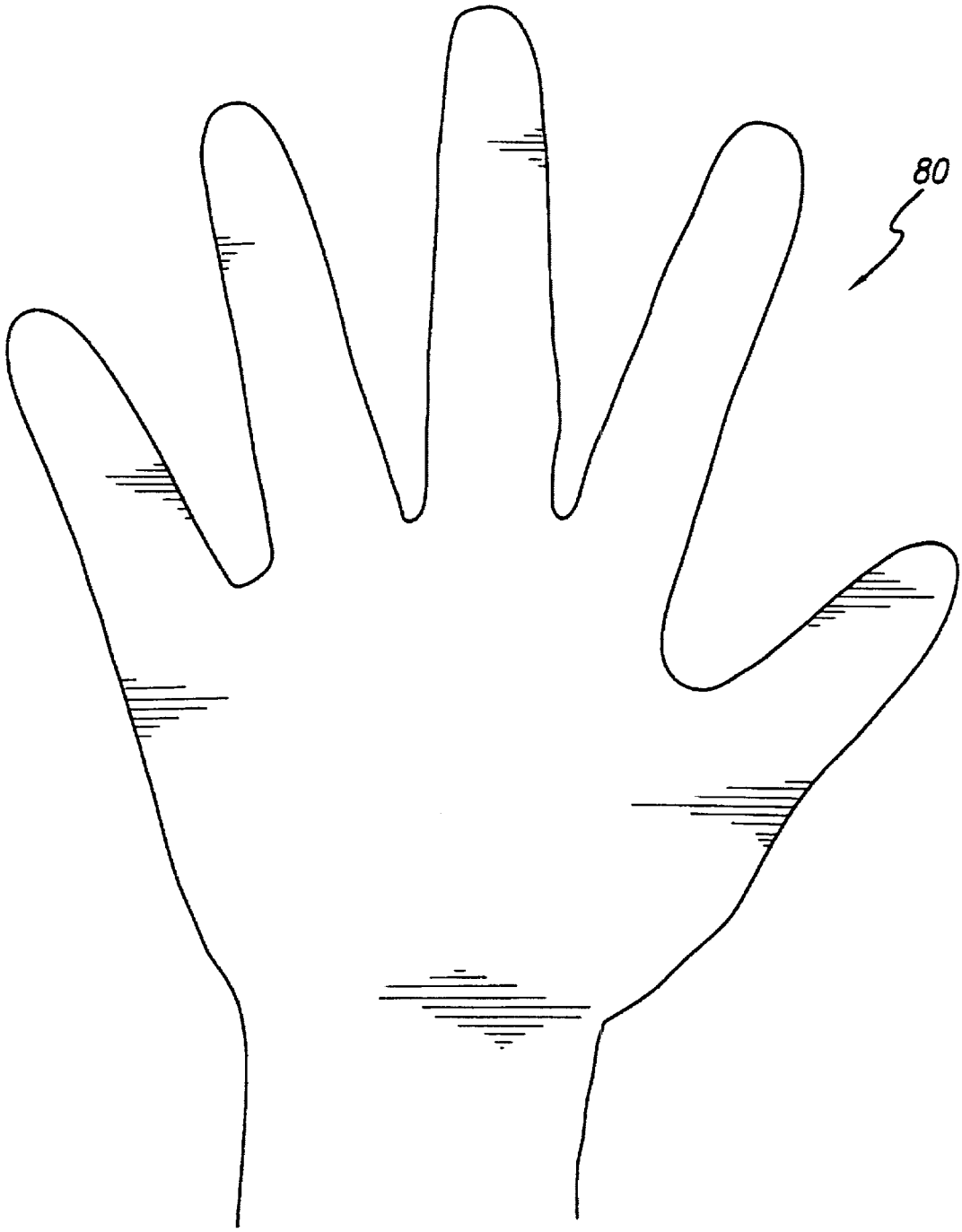
FIG. 5 is a template used for measuring a medium sized hand.
Figure 6:
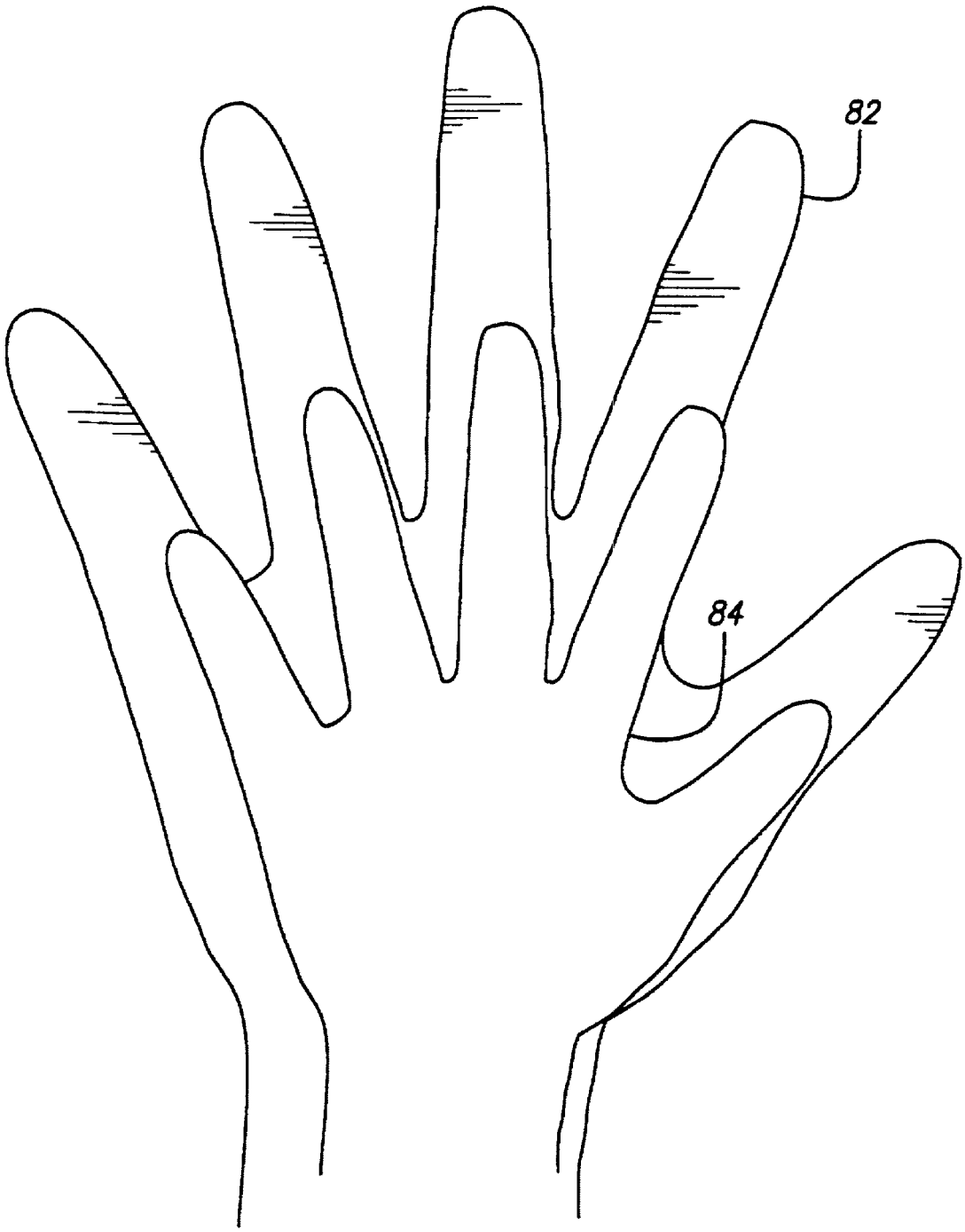
FIG. 6 are templates for a large and small hand measurement.

Obviously, if the user's hand was smaller than that shown on the template 80 on FIG. 5, then the user would place his or her hand on the smaller template 84 in FIG. 6 and from this then determine whether his or her hand was more similar to the small as opposed to the medium template.

Assuming for purposes of example, that the user's hand fitted the medium category on the measuring chart, then the user would go to the size chart set forth as shown in FIG. 7 and from that select a glove. For example, if the user wished to have a skin-colored glove going just to the wrist of the user, then the user would order a V8083SK glove. Obviously, the gloves would come in a pair so the user would have one for each hand based upon this measurement and sizing technique.

It should also be noted and such is illustrated on the sizing chart that the glove can be constructed in such a manner that the wrist portion 81 (FIG. 1) may extend along the carpus or wrist of the user by an amount ranging from 7 to 12 centimeters depending upon the glove size and the desire of the user. This extension aids in retaining the glove in position all night long on the user's hand.

It should also be noted that in many instances the fingers of the finished glove may extend beyond the finger tips of the user. By utilization of a composite elastomeric fabric as done in the present invention, the finger tips may be cut off by the user so that they conform substantially to the length of the fingers of the user. The open ends of the glove fingers subsequent to the cutting may then be resealed by an appropriate adhesive. It has been found that finger nail polish works extremely well for this purpose.

There has thus been disclosed a compression glove which can be worn for an extended period of time by a user to apply pressure to the metacarpus and phalanges of the user for the management of pain and discomfort caused by various medical conditions as well as for treatment of skin conditions of various types.

What is claimed is:

1. A method of fitting to a user's hand a compression glove constructed of elastomeric fabric stretchable in all directions and formed to be smaller than the user's hand when the fabric is in its relaxed state, said method comprising:

providing a photo of a template representative of an outline of a human hand;

placing the user's hand on at least one of said templates to ascertain a substantial match between the size of the user's hand and a template;

providing a chart of correlating templates to glove sizes; and determining the proper glove size for said user.

2. The method, as defined in claim 1, which includes the further steps of placing the user's hand on other of said templates, if said at least one template does not match, until a substantial match is found.

3. The method as, defined in claim 1, which includes the further steps of placing the user's hand in said glove; inspecting the glove to ascertain that it is snug on the user's hand; and altering the glove in those areas where the fit is not snug until a proper fit is obtained.

* * * * *